US006560348B1

(12) United States Patent
Bachmann et al.

(10) Patent No.: US 6,560,348 B1
(45) Date of Patent: May 6, 2003

(54) CONTACT CONNECTIONS

(75) Inventors: Wolfgang Bachmann, Grevenbroich (DE); Gerhard Krump, Schwarzach (DE); Hans-Jürgen Regl, Düsseldorf (DE)

(73) Assignee: Harman Audio Electronic Systems GmbH, Straubing (DE)

( * ) Notice: Subject to any disclaimer, the term of this patent is extended or adjusted under 35 U.S.C. 154(b) by 0 days.

(21) Appl. No.: 09/216,154

(22) Filed: Dec. 18, 1998

(30) Foreign Application Priority Data

Dec. 20, 1997 (DE) ..... 197 57 099

(51) Int. Cl.[7] ..... H04R 25/00

(52) U.S. Cl. ..... 381/425; 381/399; 381/152; 381/431; 181/170

(58) Field of Search ..... 381/425, 423, 381/431, 152, 396, 398, 399, 400, 406, 409; 181/157, 163, 164, 165, 170

(56) References Cited

U.S. PATENT DOCUMENTS

| | | | | | |
|---|---|---|---|---|---|
| 1,842,770 | A | * | 1/1932 | Thompson | 381/406 |
| 2,059,588 | A | * | 11/1936 | Kuhn | 381/388 |
| 3,651,283 | A | * | 3/1972 | Doschek | 381/419 |
| 4,317,965 | A | * | 3/1982 | Toyoda | 381/400 |
| 4,322,583 | A | * | 3/1982 | Maeda | 381/425 |
| 4,376,233 | A | * | 3/1983 | Kamon et al. | 381/409 |
| 4,392,027 | A | * | 7/1983 | Bock | 381/152 |
| 4,499,340 | A | * | 2/1985 | Kasai | 381/152 |
| 4,597,099 | A | * | 6/1986 | Sawafuji | 381/150 |
| 4,782,533 | A | * | 11/1988 | Haynie | 381/388 |
| 5,008,945 | A | * | 4/1991 | Murayama et al. | 381/409 |
| 5,668,886 | A | * | 9/1997 | Sakamoto et al. | 381/431 |
| 5,701,359 | A | * | 12/1997 | Guenther et al. | 381/431 |
| 5,818,947 | A | * | 10/1998 | Cattafesta et al. | 381/71.7 |
| 5,912,863 | A | * | 6/1999 | Bengtsson | 381/399 |
| 6,151,402 | A | * | 11/2000 | Azima et al. | 381/152 |
| 6,160,898 | A | * | 12/2000 | Bachmann et al. | 381/425 |
| 6,181,799 | B1 | * | 1/2001 | Azima et al. | 381/152 |
| 6,188,775 | B1 | * | 2/2001 | Azima et al. | 381/425 |
| 6,332,029 | B1 | * | 12/2001 | Azima et al. | 381/152 |

FOREIGN PATENT DOCUMENTS

| | | |
|---|---|---|
| DE | 2151085 | 5/1973 |
| DE | 2946618 | 5/1980 |
| WO | 9709842 | 3/1997 |

* cited by examiner

*Primary Examiner*—Curtis Kuntz
*Assistant Examiner*—Suhan Ni
(74) *Attorney, Agent, or Firm*—Ware, Fressola, Van Der Sluys & Adolphson LLP

(57) ABSTRACT

The invention proposes a contact connection for sound reproduction devices according to the flexural wave principle. Since the drive systems 21 of such installations require high current intensities and such current intensities could only be properly transmitted by massive contact connections which however hinder the flexural wave propagation, the object of the invention is to propose a contact connection which eliminates the problems of the state of the art, and which is also very easy to implement. To that end it is proposed that at least one of the two cover layers 12 and/or the core layer 11 contain conductive areas 17 which are connected to the lines 32 of a sound signal source. It is particularly advantageous if the conductive areas 17 can be manufactured together with the components that are also used to manufacture the core layer 11.

13 Claims, 4 Drawing Sheets

CONTACT CONNECTIONS

CROSS-REFERENCE TO RELATED APPLICATIONS

This patent application discloses subject matter that is disclosed and may be claimed in copending U.S. Patent Applications having Ser. Nos. 09/216,344 and 09/216,155, both filed on even date herewith.

TECHNICAL FIELD

The invention concerns contact connections of sound reproduction devices which operate in accordance with the flexural wave principle.

BACKGROUND OF THE INVENTION

Sound reproduction devices containing conical, flat or spherical diaphragms which are widely used to reproduce sound events, have stranded conductors that are optimized to provide an electrical contact between a stationary terminal block and the voice coil which is connected to the respective diaphragm. The special design of the conductors ensures that a permanent contact is achieved, which barely hinders the movement of the voice coil in spite of the relative movement between the voice coil and the stationary terminal block.

In addition to such sound reproduction devices, those operating in accordance with the flexural wave principle have become known of late. Such devices are essentially composed of a panel and at least one drive system, where the panel is made to oscillate when low frequency sound signals are conducted to the drive system or systems. It is characteristic for such sound reproduction devices that a flexural wave radiation is enabled starting from a critical lower cut-off frequency, where the flexural waves create a sound radiation in a frequency-dependent direction along the plane of the respective panel. In other words, a cut through a directivity diagram shows a principal lobe whose direction is frequency-dependent.

The panel is constructed in accordance with the sandwich principle, where two opposite surfaces of a very light core layer are respectively attached to a thin cover layer, for example by means of an adhesive. For the panel to have good sound reproduction properties, the material for the cover layer must have an especially high dilatational wave speed. Suitable cover layer materials are for example thin metal foils and also fiber-reinforced plastic foils. Special demands are also made on the core layer since this layer must have a very high modulus of elasticity in the direction of the two surfaces that are equipped with cover foils, while it must have a very low modulus of elasticity in the direction that is parallel to the surfaces equipped with cover foils. This anisotropic behavior of the core layer is achieved for example by giving the core layer a honeycomb structure in which the walls that form the honeycombs extend vertically to the two cover layers. Light metals and fiber-reinforced plastics proved to be suitable materials for the honeycomb structure of the core layer. It is also possible to use hard foams for the core layer insofar as they have openings that extend between the two cover layers.

If sound reproduction devices according to the flexural wave principle are equipped with drive systems which are integrated into or onto the panel as illustrated in a parallel application, the electrical connections known from sound reproduction devices with conical, flat or spherical diaphragms cannot be used to make contact with the voice coil. This can be attributed to the fact that high current intensities must be supplied to the drive systems of sound reproduction devices that operate in accordance with the flexural wave principle. Because of the high accelerating forces, this can only be realized with very stable contact connections, which however heavily dampen the flexural wave propagation.

SUMMARY OF THE INVENTION

It is therefore the object of the invention to propose a contact connection for sound reproduction devices according to the flexural wave principle, which is very simple to implement and has a heavily reduced damping effect on the flexural wave propagation and avoids voltage losses due to high transition resistances.

This object is achieved by a contact connection for a sound reproduction device according to the flexural wave principle, with a panel which is composed of a core layer, a top and a bottom cover layer, where the two cover layers are attached to opposite sides of the core layer, and with at least one drive system which is connected to the panel and can be connected to a sound signal source by means of two lines, wherein at least one of the two cover layers and/or the core layer have conductive areas, and that these conductive areas are conductively connected to the lines of the sound signal source and the corresponding connections of the respective drive systems.

The basic idea of the invention is to use the components of the panel for contacting the voice coil and the sound signal source, because it has been discovered that the cover layers and/or the core layer can be used as exceptionally good power conductors for the voice coil if the core layer or at least one of the cover layers contain conductive areas.

The two cover layers which cover the core layer can be used as conductive areas if they are manufactured of a material that conducts electric current and are separated by an insulating core layer. The use of two cover layers which are entirely manufactured of a conductive material also has the additional advantage that when using a number of drive systems per panel, no separate power conductors need to be supplied for the individual drive systems. The electrical connection of the respective drive system only requires that the respective contacts of this drive system are connected to one of the two cover layers. This type of contact connection of drive systems achieves a high flexibility in the arrangement of the drive systems in or on the panel, because any changes in the arrangement of the different drive systems do not require any reconfiguration of the power supply.

Only one cover layer of conductive material is necessary if the cover layer is subdivided into at least two insulated segments. Such an arrangement has the advantage that the panel requires no special insulation if the cover layer which is subdivided into segments is located so that it faces away from the listening room.

The core layer can also be used as a power conductor if it contains conductive areas.

If it is necessary to construct the conductive areas of the core layer massively, they must then have the same distance from the cover layers. This ensures that these conductive areas are not subjected to stretch forces from the effect of flexural waves.

If the core layer has a perforated structure that contains openings, and if the core layer is formed of an insulator, these openings can also be very simply used to conduct signals if the openings are equipped with a conductor which is connected to the corresponding conductive area. Such conductors are not limited to the conductive plastic materials that fill the respective openings, but they can also be massive wires since conducting the wires in the openings does not hinder the bending of the core layer 11 crosswise to its greatest expansion.

If the core layer is formed of a number of small strips, where each strip which is adjacent to another strip is connected to it by a number of reciprocally separated connection places extending in the direction of the narrow side of the strips, and where the unconnected areas of the strips are placed at a reciprocal distance from each other, and if at least one of these strips is made of a conductive material, it is possible to produce conductive areas in the core layer without any special effort.

The above-mentioned openings can be used to transmit the sound signal conducted in the strip or strips, if these openings are equipped with a conductor which is connected to said conductive material strip.

The supply of sound signals to the panel is particularly simple if the panel is surrounded by a holder and is connected thereto. It is particularly advantageous if the attachment means whereby the panel is linked to the holder simultaneously establish a conductive connection between the stationary connection clamps on the holder and the corresponding conductive area of cover layer and/or core layer.

BEST MODE FOR CARRYING OUT THE INVENTION

The invention will now be explained in greater detail by means of the figures.

Figure 1:
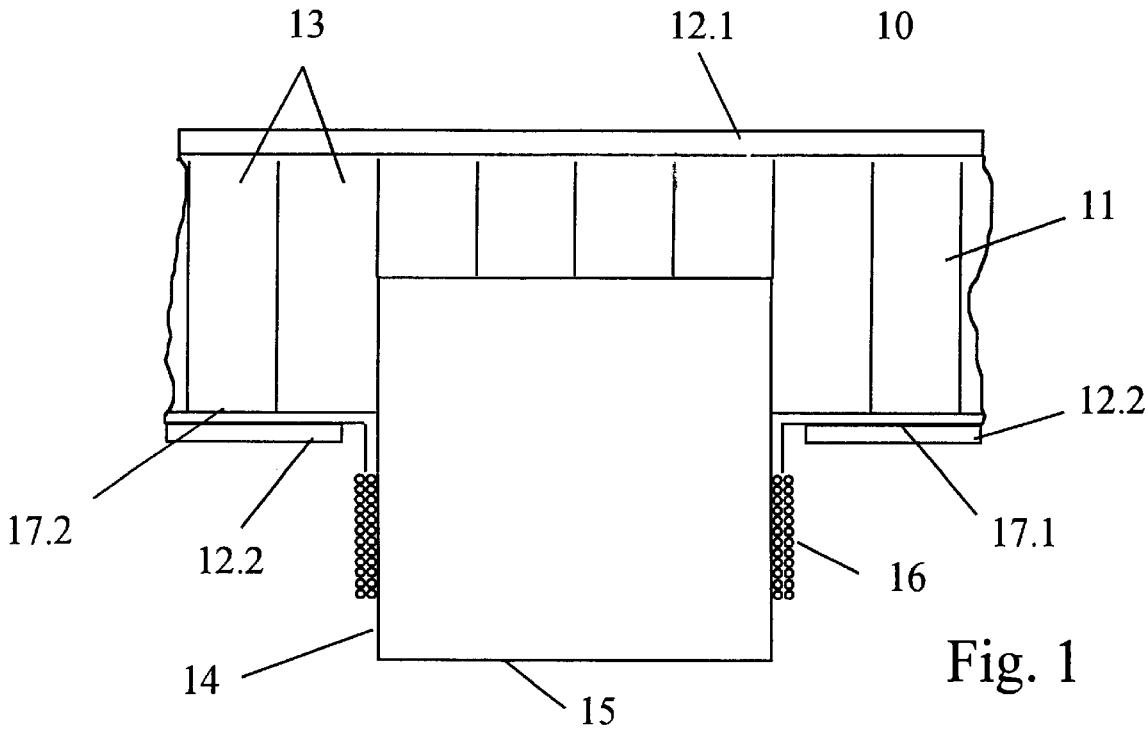
FIG. 1 is a schematic lateral view of a panel.

FIG. 1 illustrates a panel which is composed of a core layer 11 and a top and a bottom cover layer 12.1, 12.2. The two cover layers 12 are connected to opposite sides of the core layer 11. The schematic illustration in FIG. 1 shows that the core layer 11 has a perforated structure which contains openings 13. There the openings 13 extend vertically between the two cover layers 12. For the purpose of completeness it should also be pointed out that in other not illustrated embodiments the core layer 11 can also be formed entirely of a hard foam.

A voice coil support 14 is also inserted into the core layer 11 and its free end 15 protrudes from the panel 10. In addition the free end 15 of the voice coil support 14 is equipped with a voice coil 16. For the purpose of completeness it should also be pointed out that in a ready-to-operate panel 10, the free end 15 of the voice coil support 14 as well as the voice coil 16 are connected to a not illustrated drive system.

The not illustrated wire ends, which are required to supply current to the voice coil 16, are connected respectively to a conductive area 17.1, 17.2. In the embodiment illustrated in FIG. 1, the two conductive areas 17.1, 17.2 are formed of wires which respectively extend between the bottom cover layer 12.2 and the core layer 11. In a not illustrated embodiment, the conductive areas 17 or wires can be located in a corresponding cutout of the core layer 11. If the cited wires are used as conductive areas 17, they should however be installed in a flexible material to prevent so-called "wire buzzing" which can possibly occur when the panel 10 bends during its operation. Due to the improved bodily contact, the latter measures are superfluous if the cited wires of the embodiment in FIG. 1 comprise conductive areas 17 in the form of conductive foils, which are laminated to the side of the bottom cover layer 12.2 that faces the core layer 11.

Figure 2:
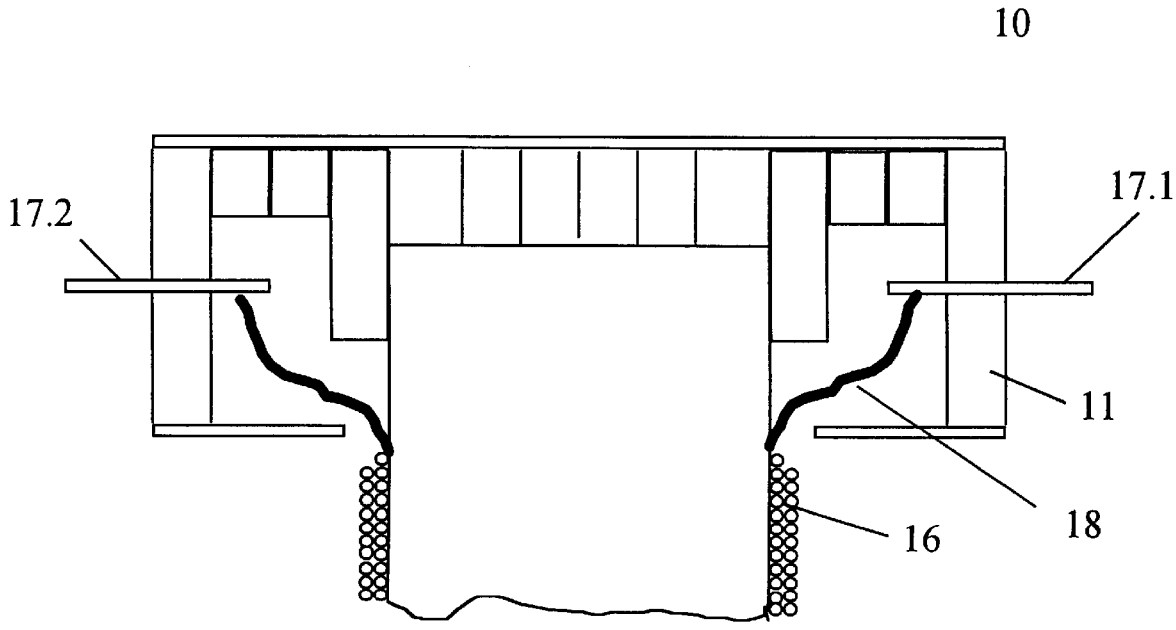
FIG. 2 is a schematic lateral view of another panel.

In contrast to the configuration according to FIG. 1, the conductive areas in the embodiment according to FIG. 2 are conducted centrally through the core layer between the two cover layers 12. The advantage of this configuration is that no stretch forces affect the conductive areas when the panel 10 bends during its operation. For that reason the conductive areas 17 shown in FIG. 2 can also be formed of massive wires or bolts, which are inserted into the core layer 11 from its narrow side. According to FIG. 2 the voice coil 16 is electrically connected to the conductive areas 17 through flexible wires 18.

Figure 3:
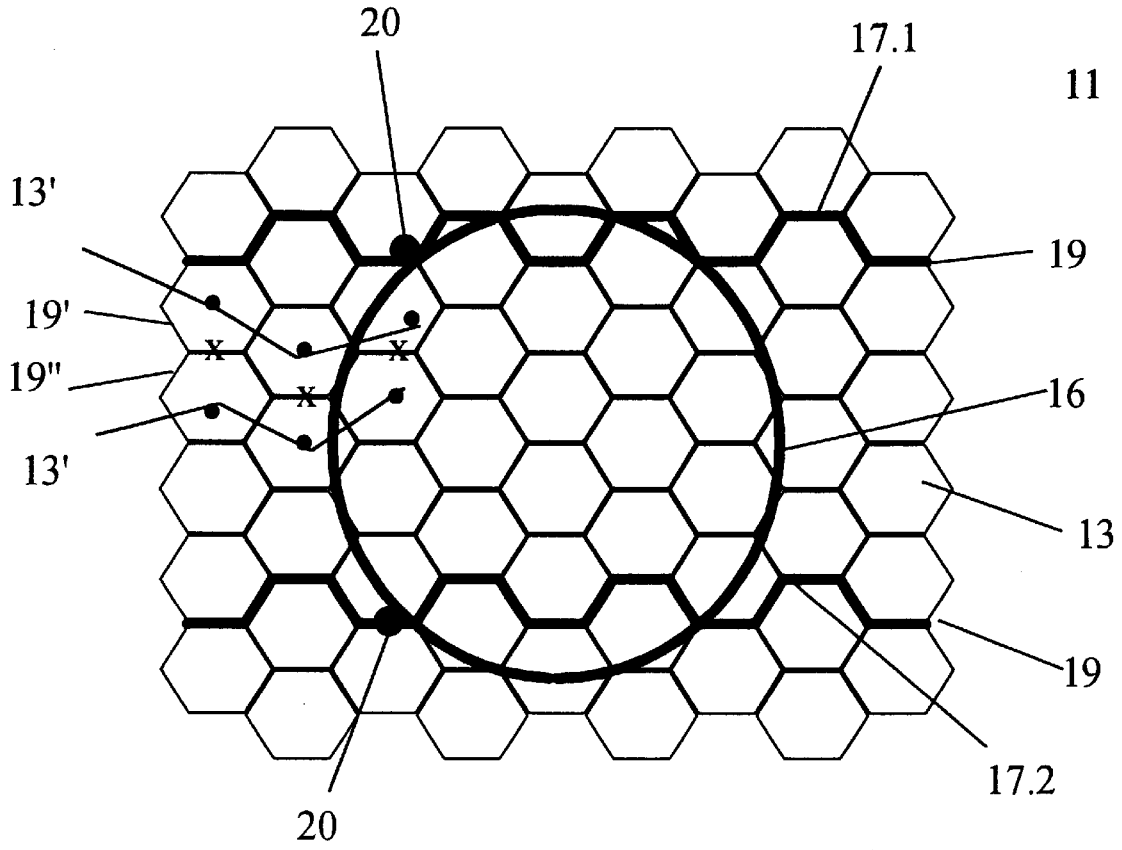
FIG. 3 is a (schematic) top view of a core layer.

FIG. 3 illustrates a top view of a core layer 11 in which the cover layers 12 that cover the core layer 11 have been omitted. This illustration depicts the perforated structure of the core layer 11 that is formed of a number of openings 13 which have honeycomb-shaped cross sections.

Such perforated structures are built by first stacking a number of narrow strips over each other. Each strip on which a further strip is stacked is then provided with a number of reciprocally separated connection areas (mostly in the form of adhesive material beads) which extend in the direction of the narrow strip side. Once all the strips have been stacked and interconnected with each other, the stack is drawn apart resulting in the perforated core layer 11 structure in FIG. 3. FIG. 3 shows an example of the connection of two strips 19', 19" for six of the depicted openings 13', where the respective connection areas between the two strips 19', 19" are identified with an X.

The embodiment according to FIG. 3 further illustrates two strips 19 that are drawn with bold lines. These strips are made of a conductive material and form the conductive areas 17.1, 17.2 of the core layer 11. It is clear in conjunction with the last paragraph that by using at least one strip 19 of conductive material, conductive areas 17 can be very easily provided in the core layer 11 without any changes in the production. Deviating from FIG. 3, if only one strip 19 of conductive material is inserted into the core layer 11 in accordance with the last paragraph, it must be ensured before contacting the voice coil 16 that this single strip 19 is split into two separate partial areas which are insulated from each other.

When viewing FIG. 3, the voice coil 16 is vertical to the paper plane. At the contact points 20, the corresponding wire ends (not illustrated) of the voice coil 16 are respectively connected to one of the two conductive material strips 19.

Insofar as the voice coil 16 is located at an axial distance from the core layer 11 as illustrated in FIG. 1, the connection between the voice coil 16 and the strips according to FIG. 3 can be established by means of a corresponding conductor (not illustrated). To that end the opening 13 from which the not illustrated conductor emerges can be filled with a conductive plastic material. The connection between the conductor and the conductive plastic material can be in the form of a plug connection which is simply plugged into the plastic material.

Figure 4:
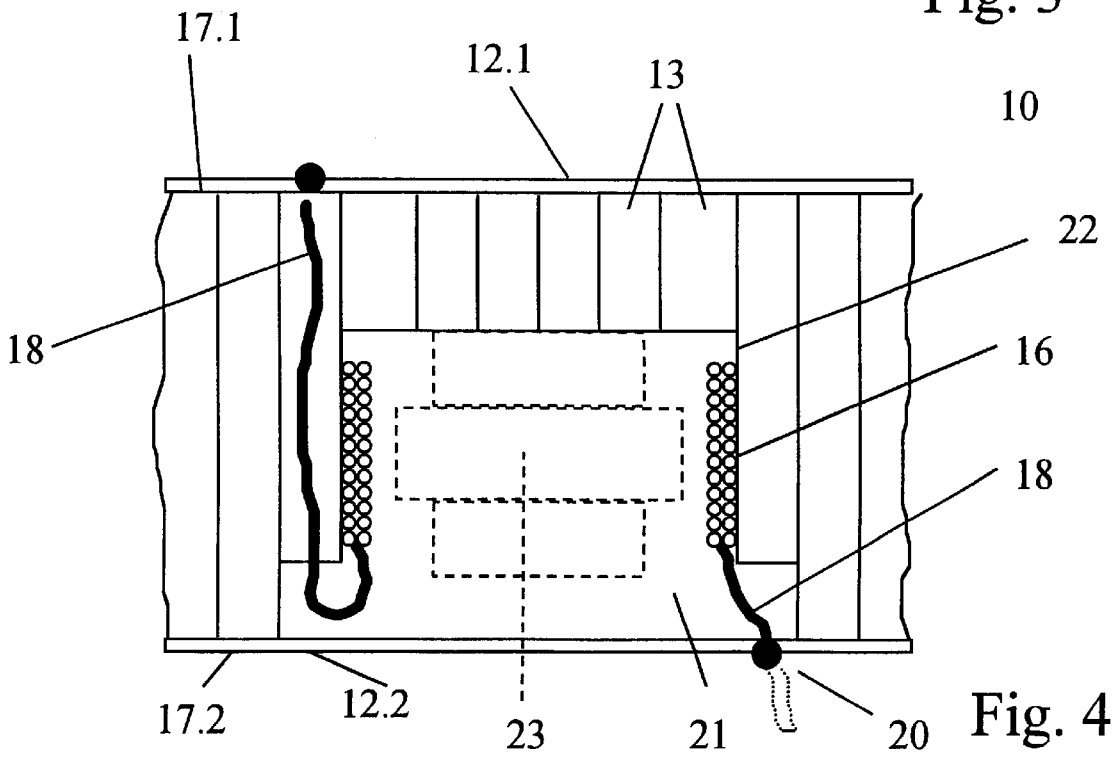
FIG. 4 is a view of another panel according to FIG. 1.

FIG. 4 illustrates a panel 10 in which the voice coil 16 is located inside the core layer 11. This is achieved by forming a cutout 21 in the core layer 11 which is made of an insulator, and the voice coil 16 is connected to the walls 22 that form the openings 13. Furthermore the drive system 23 which is only indicated schematically, is integrated into the cutout 21. By means of flexible wires 18 the voice coil 16 is connected to the conductive areas 17.1, 17.2, which in this case are formed of the cover layers 12.1, 12.2 made of a conductive material. The flexible wire 18 which connects the voice coil 16 to the top cover layer 12.1 is led through one of the openings 13. Insofar as so-called "wire buzzing" is feared, the respective opening 13 that receives the flexible wire 18 can also be filled with a flexible foam material. Since the voice coil 16 must be inserted into the cutout 21 at least before the bottom cover layer 12.2 is attached to the core layer 11, the connection between the flexible wire 18 and the bottom cover layer 12.2 is designed so that the wire 18 passes through the bottom cover layer 12.2 (indicated by the dotted wire end), and is soldered for example at the contact point 20 to the side of the bottom cover layer 12.2 which faces away from the core layer 11.

Figure 5:
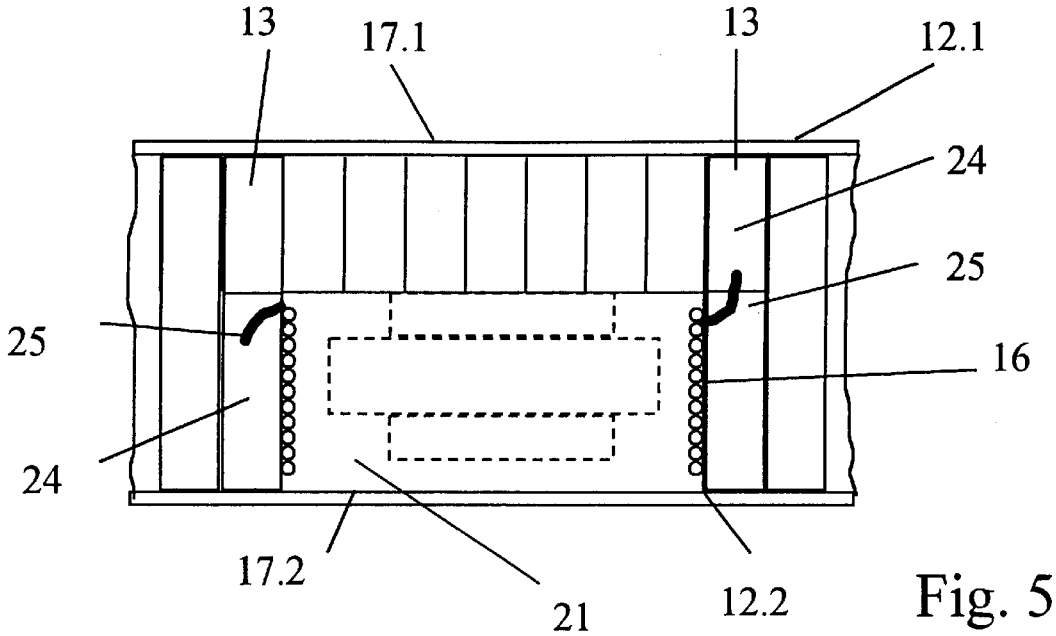
FIG. 5 is a view of another panel according to FIG. 1.

However in the configuration according to FIG. 5 which relates most to the embodiment in FIG. 4, the use of flexible wires 18 for connecting the voice coil 16 was omitted. Instead, two openings 13 next to the cutout 21 are partially filled with a conductive plastic foam material 24 (indicated by broken lines), and the wire ends 25 of the voice coil 16 are plugged into the conductive plastic material 24. Since in this embodiment the two cover layers 12 are also made of a conductive material, the connection between the conducting areas 17 in the form of the two cover layers 12 and the voice coil 16 are established by the conductive plastic material 24.

To improve the stability of the connection between the wire ends and the conductive plastic material 24, in another embodiment which is not further illustrated the rest of the respective opening 13 which is partially filled with the plastic material 24 can additionally be filled with an insulating material.

Figure 6:
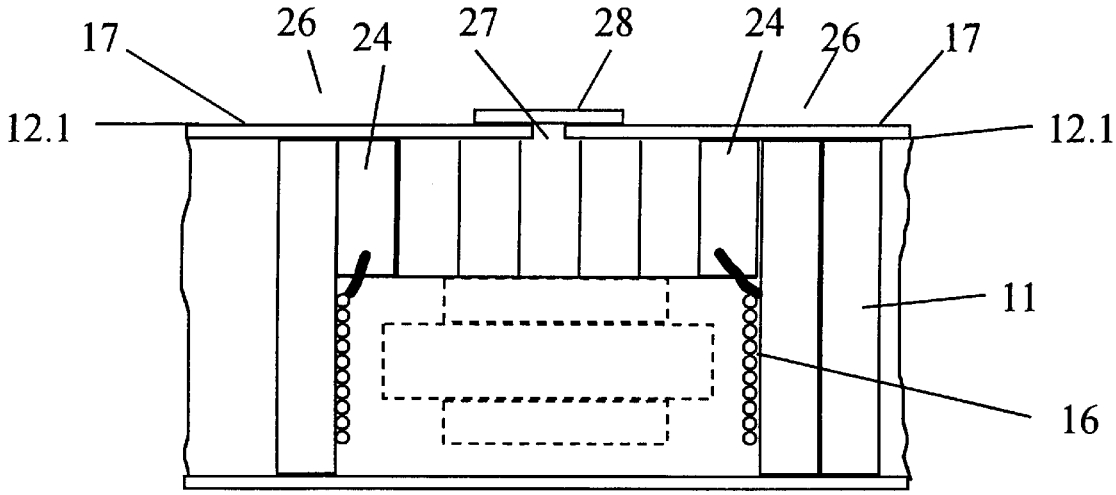
FIG. 6 is a view of another panel according to FIG. 1.

In contrast to the embodiments according to FIGS. 4 and 5, the conductive areas 17 in FIG. 6 are exclusively provided by the top cover layer 12.1. To that end the top cover layer 12.1 is subdivided into two segments 26 which are insulated from each other. The resulting gap 27 between the segments 26 is closed with a cover strip 28, which like the core layer 11 is made of an insulation material. As in the configuration according to FIG. 5, the contact between the two segments 26 and the voice coil 16 is provided by the foam fill of a conductive plastic material 24.

Figure 7:
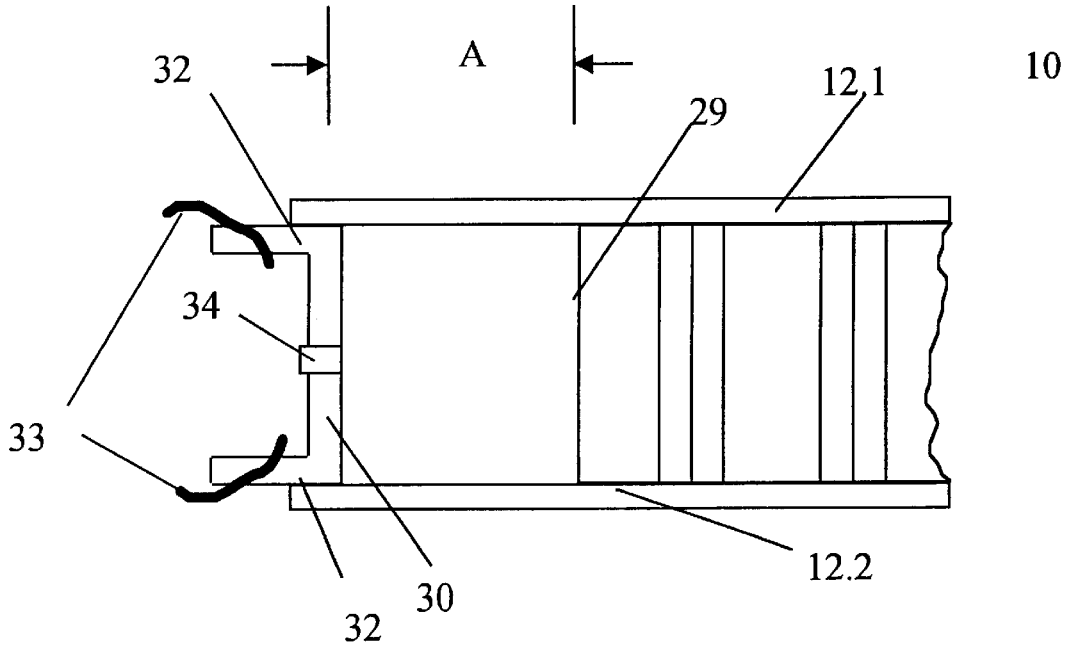
FIG. 7 is a schematic lateral view of an edge fastener of a panel.

FIG. 7 illustrates the edge 29 of a panel 10. A holder 30 of insulation material which in this case has a U-shaped profile, is located at a lateral distance A from the edge 29. The two cover layers 12 which are attached to the core layer 11 extend to the holder 30 and in this way form a bridge over the space A. In other words, this type of configuration has the two cover layers 12 acting as fastening means for the panel in the space A. Since the two cover layers 12 of this embodiment form the conductive areas 17 (somewhat like FIG. 5), extending the two cover layers 12 to the holder 30 simultaneously provides a conductive connection between the oscillating panel 10 and the stationary holder 30 without any great additional effort. Reference numeral 33 identifies two connection lines coming from a not illustrated sound signal source, which extend to the holder 30. To allow the U-shaped holder 30 to be simultaneously used as a terminal connector for the connecting lines 33, the shanks 32 of the holder 30 which are separated by the insulation 34 are made into so-called soldering lugs whereby the connecting lines 33 are plugged in and soldered. If required, electronics for controlling the voice coil 16 which is not illustrated in this figure can be placed between the two shanks 32 or in the space A between the holder 30 and the core layer 11.

Figure 8:
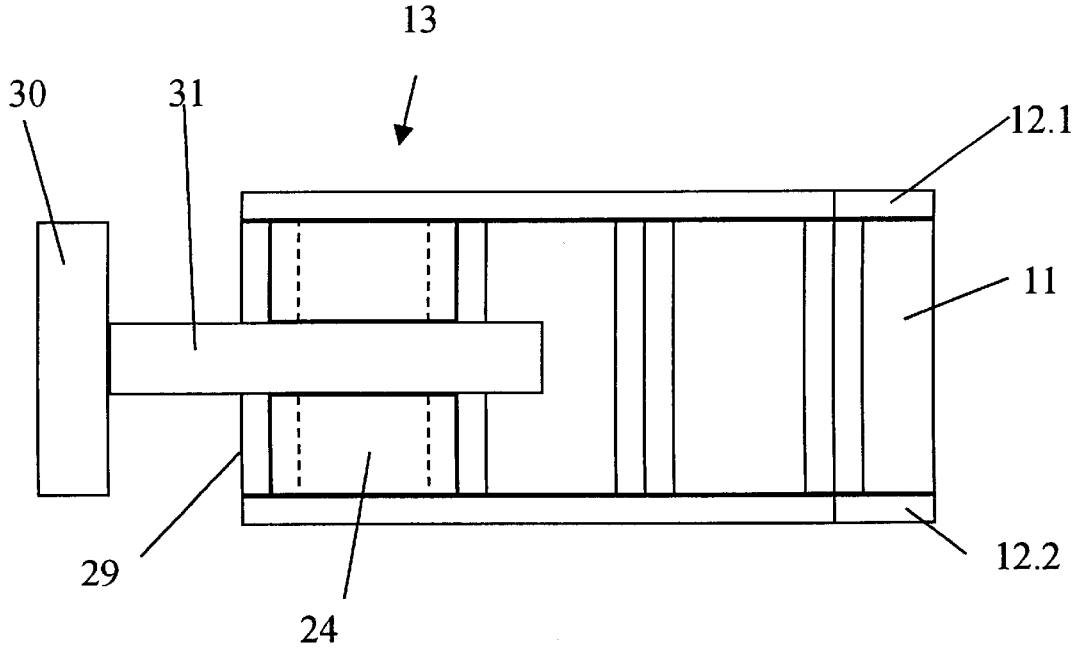
FIG. 8 is a schematic lateral view of another edge fastener of a panel.

FIG. 8 also illustrates an attachment of the panel 10. A stem 31 of a conductive material which is plugged in and fastened to the core layer, establishes the connection between the edge 29 and the holder 30. The stem 31 is secured by filling the opening 13 through which the stem 31 passes with a plastic material. In this case the plastic material which is placed between the stem 31 and the top cover layer 12.1 is an insulator, while the plastic material which is placed between the stem 31 and the bottom cover layer 12.2 is a conductive plastic material 24. This ensures that the stem 31 is conductively connected to the bottom cover layer 12.2. For the purpose of completeness it should also be pointed out that the also conductive top cover layer 12.1 makes contact at another place on the edge 29 by means of a FIG. 8 arrangement.

What is claimed is:

1. A contact connection for a sound reproduction device according to the flexural wave principle, with a panel (10) which is composed of a core layer (11), a top and a bottom cover layer (12.1, 12.2), where the two cover layers (12) are attached to opposite sides of the core layer (11), and with at least one drive system (23) which is connected to the panel (10) and can be connected to a voice coil (16) by means of two lines (18) characterized in that at least one of the two cover layers (12.1, 12.2) and/or the core layer (11) have conductive areas (17.1, 17.2), and that these conductive areas (17) are conductively connected to the voice coil (16) via the lines (18) and the corresponding connections (25) of the respective drive systems (23) in order to supply electrical current to the voice coil (16).

2. A contact connection as claimed in claim 1, characterized in that the two cover layers (12) are made of a conductive material and that the core layer (11), which is composed of an insulator, insulates the two cover layers (12) from each other.

3. A contact connection as claimed in claim 1, characterized in that one of the cover layers (12) is subdivided into at least two segments (26) which are insulated from each other, and that each segment (26) is composed of a conductive material.

4. A contact connection as claimed in claim 1, characterized in that the core layer (11) has conductive areas (17) which essentially extend parallel to one of the two cover layers (12).

5. A contact connection as claimed in claim 1, characterized in that the core layer (11) has a perforated structure in which a plurality of openings (13) extend between the two cover layers (12), that the core layer is composed of an insulator and that at least one of the openings (13) is equipped with a conductor (18) which is connected to one of the conductive areas (17).

6. A contact connection as claimed in claim 1, characterized in that the panel (10) is encompassed by a holder (30), that a reciprocal space (A) exists between the panel (10) and the holder (30) in which a fastening means (12; 30) is placed between the holder (30) and the panel (10), and the respective conductive areas (17) of cover layers (12.1, 12.2) and/or the core layer (11) also extend to the holder (30).

7. A contact connection as claimed in claim 6, characterized in that the fastening means (12; 30) itself forms the conductive connection between the panel (10) and the holder (30).

8. A contact connection for a sound reproduction device according to the flexural wave principle, with a panel (10) which is composed of a core layer (11), a top and a bottom cover layer (12.1, 12.2), where the two cover layers (12) are attached to opposite sides of the core layer (11), and with at least one drive system (23) which is connected to the panel (10) and can be connected to a sound signal source (16) by means of two lines (18) characterized in that at least one of the two cover layers (12.1, 12.2) and/or the core layer (11) have conductive areas (17.1, 17.2), and that these conductive areas (17.1, 17.2) are conductively connected to the lines (18) of the sound signal source (16) and the corresponding connections (25) of the respective drive systems (23) in order to supply electrical current to the sound signal source (16), wherein the conductive areas (17) which extend parallel to one of the two cover layers (12) have the same distance from the two cover layers (12).

9. A contact connection as claimed in claim 8, characterized in that the core layer (11) has a perforated structure containing openings (13) extending between the two cover layers (12), and that the core layer is composed of an insulator and that at least one of the openings (13) is equipped with a conductor (18) which is connected to one of the conductive areas (17).

10. A contact connection for a sound reproduction device according to the flexural wave principle, with a panel (10) which is composed of a core layer (11), a top and a bottom cover layer (12.1, 12.2), where the two cover layers (12) are attached to opposite sides of the core layer (11), and with at least one drive system (23) which is connected to the panel (10) and can be connected to a sound signal source (16) by means of two lines (18) characterized in that at least one of the two cover layers (12.1, 12.2) and/or the core layer (11) have conductive areas (17.1, 17.2), and that these conductive areas (17.1, 17.2) are conductively connected to the lines (18) of the sound signal source (16) and the corresponding connections (25) of the respective drive systems (23) in order to supply electrical current to the sound signal source (16), wherein the core layer (11) is composed of a number of narrow strips (19) each having a narrow side, where each strip (19) which is adjacent to another strip (19) is connected to the latter by a number of reciprocally separated connection area (X) which extend in a direction of the narrow side of the strips (19), and where the unconnected areas of the strips (19) have a reciprocal space, and that at least one of theses strips (19) is made of a conductive material.

11. A contact connection as claimed in claim 10, characterized in that at least one of the conductive areas (17.1, 17.2), wherein a strip (19) of a conductive material has a reciprocal space with respect to said strip (19) made of an insulating material, is equipped with a conductor (18; 24), and wherein a conductive connection is provided between the conductor (18; 24) and the conductive strip (19).

12. A contact connection as claimed in claim 11, characterized in that the panel (10) is encompassed by a holder (30), that a reciprocal space (A) exists between the panel (10) and the holder (30) in which a fastening means (12; 31) is placed between the holder (30) and the panel (10), and the respective conductive areas (17) of cover layers (12.1, 12.2) and/or the core layer (11) also extend to the holder (30).

13. A contact connection as claimed in claim 12, characterized in that the fastening means (12; 30) itself forms the conductive connection between the panel (10) and the holder (30).

* * * * *